United States Patent [19]

Casciotti et al.

[11] Patent Number: 4,508,401

[45] Date of Patent: Apr. 2, 1985

[54] WOVEN CABLE CONNECTOR

[75] Inventors: Albert Casciotti, Hershey; Earl W. McCleerey; Pete Cosmos, both of Mechanicsburg, all of Pa.

[73] Assignee: AMP Incorporated, Harrisburg, Pa.

[21] Appl. No.: 495,879

[22] Filed: May 18, 1983

[51] Int. Cl.[3] ..... H01R 4/66; H01R 11/20; H01R 43/04

[52] U.S. Cl. ..... 339/14 R; 29/857; 29/861; 174/117 M; 339/95 D; 339/97 P; 339/103 M

[58] Field of Search ..... 339/176 MF, 176 M, 14 R, 339/17 F, 95 R, 95 D, 96, 97 R, 97 P, 98, 99 R, 103 M, 107; 174/117 M; 29/857, 861

[56] References Cited

U.S. PATENT DOCUMENTS

| | | | |
|---|---|---|---|
| 3,353,141 | 11/1967 | Budai | 339/107 X |
| 3,627,903 | 12/1971 | Plummer | 174/72 A |
| 3,909,508 | 9/1975 | Ross | 174/117 M |
| 4,026,013 | 5/1977 | Hughes | 29/628 |
| 4,105,278 | 8/1978 | Braund et al. | 339/176 MF X |
| 4,260,209 | 4/1981 | Zell et al. | 339/14 R |
| 4,310,208 | 1/1982 | Webster et al. | 339/17 F X |
| 4,327,956 | 5/1982 | Sitzler | 339/107 |

*Primary Examiner*—John McQuade
*Assistant Examiner*—Steven C. Bishop
*Attorney, Agent, or Firm*—Russell J. Egan

[57] ABSTRACT

A method and connector are disclosed for terminating woven cable formed by a box woven yarn carrying a plurality of magnet wire conductors in a high density parallel spaced array. The cable is preformed with terminating areas in which the magnet wire is freed of the weave. The connector includes a base member, which receives the cable and positions the ground wires, an intermediate member including first ground terminals receiving the ground wires in the base member and receiving the signal wires thereon in a spaced array, and a mating member carrying second signal terminals for engaging respective signal wires and selective ground terminals for programming ground interconnect for the connector.

16 Claims, 7 Drawing Figures

28
10
12
26
24
28
92
88
90
80
82
84
86

30
16
78
70
76
74
20
72
64
66
14
22
26
34
36
12
24
18

WOVEN CABLE CONNECTOR

The present invention relates to a connector for terminating woven multi-conductor cable and in particular a connector which receives separated ground and signal conductors of such cable for individual termination and programming of the ground.

There are a wide variety of types of electrical cables and each type has its own particular problems with respect to making an effective inter-connection or termination. Multiple conductor cables can also have a further problem when it is desired to terminate the cable in such fashion that individual conductors are utilized to perform a specific function, for example signal conducting and programmed ground. The arrangement of signal and ground conductors in a single cable is well known and such an arrangement provides particular advantages in that the arrangement of ground wires can be such as to substantially reduce cross-talk between the signal conductors, to control the electrical characteristics of the cable, and be somewhat similar to shielded cable, but of less expensive construction and of somewhat easier handling. Examples of woven cables may be found in U.S. Pat. Nos. 3,627,903 and 3,909,508.

A particular type of woven multi-conductor cable is manufactured by Woven Electronics Company and comprises a box woven yarn and magnet wire transmission cable. This cable has had increasing popularity because of its flexibility, density, and low cross talk characteristics. It is also possible to control the impedance of such cable simply by varying the weaving pattern. Heretofor cable of this type has been terminated by a laborious hand soldering and lead inter-connecting process. The individual conductors must be separated from the cable, secured to a connector by soldering and the entire assembly potted to assure both insulation and strain relief. This method is costly and prone to error since it is very operator dependent.

The present invention overcomes the difficulties of the prior art in terminating woven cable by providing a multi-part housing including a base member which receives the ground wires, an intermediate member, which carries a ground wire securing terminal and which receives the signal conductors spaced from the ground conductors, and a mating member, which carries a plurality of terminals each aligned to engage with a respective signal conductor or group of ground conductors through a respective intermediate terminal in such fashion as to be readily programmable. The present invention can include a cover for providing strain relief for the cable and can be equipped with latching and keying devices of the type which are well known in the electrical connector industry.

Present invention will now be described by way of example with reference to the drawings in which.

Figures 1, 2:
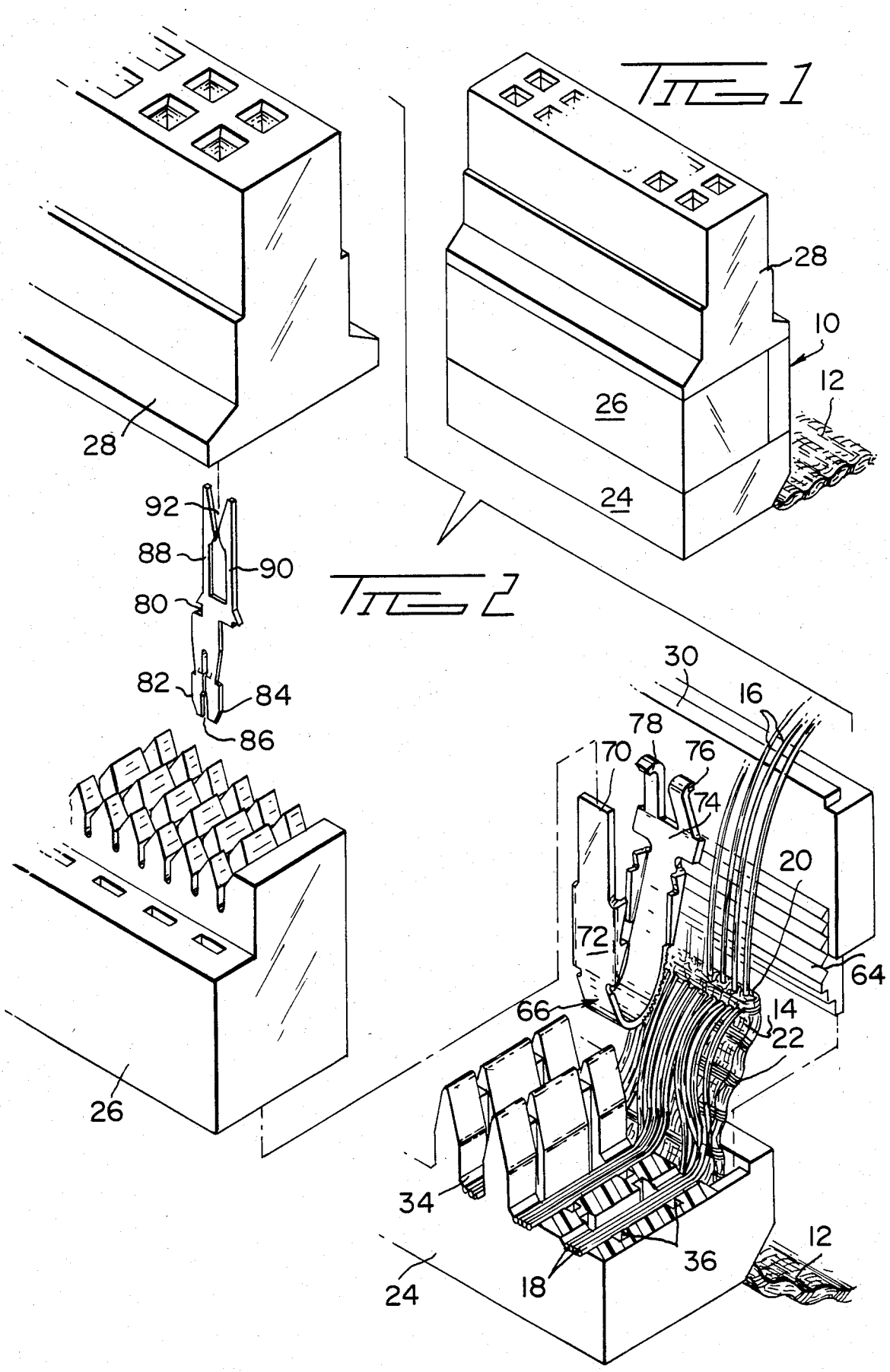
FIG. 1 is a perspective view of a woven cable connector according to the present invention.
FIG. 2 is an exploded perspective view of an end portion of the connector of FIG. 1.

The subject connector 10 is shown in the FIGURES terminating a free and of a woven cable 12. This cable is of the previously described type having a box woven yarn base 14 and a plurality of wires arranged at signal conductors 16 and ground conductors 18 arranged in a ground, signal, ground, ground, signal, ground, etc. pattern. The conductors extend in the direction of the warp threads 20 and are secured to the base 14 by the interwoven woof thread 22. It is possible to manufacture cable of this nature so as to periodically have portions where the woof thread 20 lies against the base 14 so that the conductors 16 and 18 are above and to each side of or on respective sides of the base 14 and can be freed from the cable by cutting transversely in this portion. This will be described in more detail later with reference to FIGS. 6 and 7.

The subject connector 10 has a base member 24, an intermediate member 26, a mating number 28, and a cover 30 all made of rigid insulative material and having a generally elongated profile. Only one end of the connector has been shown in detail in FIG. 2.

The base member 24 is an elongated member having an elongated cable entry 32 along one edge thereof. This cable entry 32 is preferably profiled to perform a strain relief function in cooperation with the cover 30, as will be described later. The base number 24 also has at least one ground wire channel 34, extending normal to the cable entry 32 with each channel 34 being provided with a terminal recess 36.

The intermediate number 26 has been shown as an integral member but it could likewise be a two part assembly since two functions are performed by this member. The intermediate member 26 has a lower surface 38 containing at least one plurality of recesses 40, equal in number to the terminal recesses 36 of the base member 24 and located immediately above and in alignment therewith. The intermediate number 26 also has an upper profiled surface 42 defining a plurality of passages 46, 48 and 50 extend between the surface 42 and the recesses 40. It will be noted that passages 46, 48 have an enlarged profile where they enter recess 40.

The mating member 28 has a lower surface 52 with an elongated recess 54 therein and an oppositely directed mating face 56. A plurality of terminal passages 58 and 60 extend between the mating face 56 and the recess 54.

The cover 30 has a profiled nose portion 62 which extends into the cable entry 32 of base member 24. Surface 64 is profiled to engage with the profiling of the entry 32 to perform a cable strain relief function therebetween. The upper end 65 is profiled to engage the mating member 28.

The connector 10 is also provided with a plurality of first terminals 66 and a plurality of second terminals 68. Each first terminal 66 is preferably of the type disclosed in U.S. Pat. No. 4,026,013, the disclosure of which is incorporated herein by reference, and has a generally U shaped profile formed by a first portion 70, an intermediate bent, second portion 72, and a trailing third portion 74. On the ends of the trailing third portion 74 are a pair of programming arms 76–78. These arms can be left straight or selectively formed, as shown, for programming ground as will be explained later. Each second terminal 68 has a body portion 80 with a first pair of parallel spaced arms 82, 84 extending in a first direction therefrom defining a conductor engaging slot 86 therebetween and an oppositely directed mating end here shown as 88, 90 defining a terminal pin receiving passage 92 therebetween. It is to be understood that this mating end of the second terminals can have any suitable profile such as a pin or receptacle.

Figure 6:
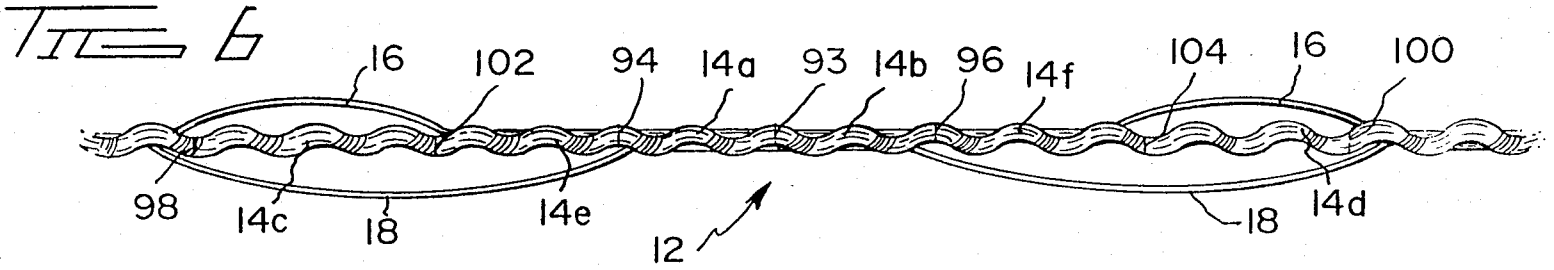
FIGS. 6 and 7 are diagrammatic side elevations showing the steps necessary to prepare the woven cable for termination by the subject connector.
Figure 7:
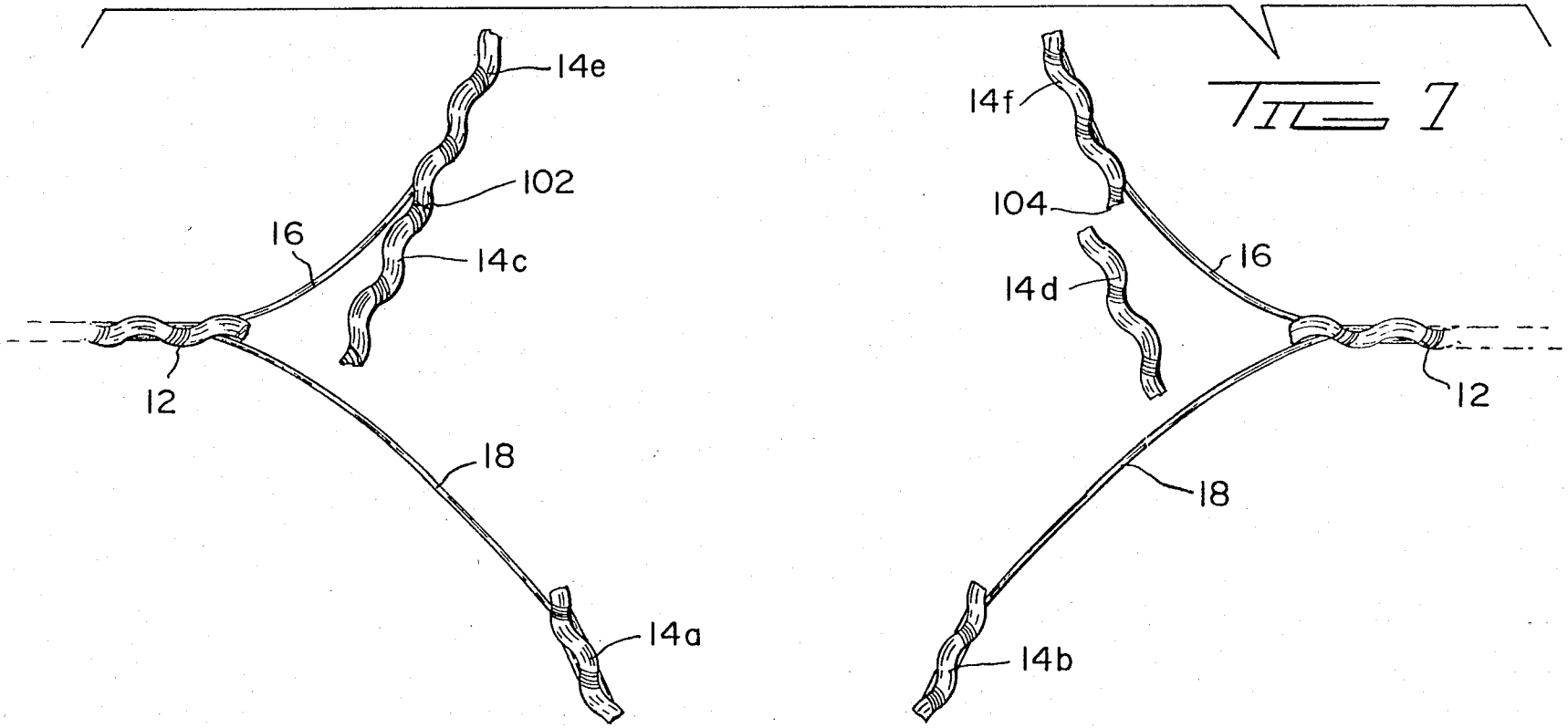

Woven cable of the above described type to be terminated is prepared as shown in FIGS. 6 and 7. The cable 12 shown in FIGS. 6 and 7 has been produced with a segment having two spaced areas on a first side where the signal conductors 16 are free of the base 14 and two spaced larger areas 18 on the opposite side. The areas for the ground wires are coextensive with those of the first side. The cable 12 is first cut transversely at 93 to separate it into two segments. The base 14 is next cut at 94, 96 to free the ends of the ground wires 18 while leaving segments 14*a* and 14*b* on the free ends to maintain the alignment of the conductors. The base 14 is then cut at 98, 100 to separate the signal conductors and again at 102, 104 to remove the extra base material 14*b*, 14*c* while leaving segments 14*d* and 14*e* on the free ends to align the signal wires.

Figure 3:
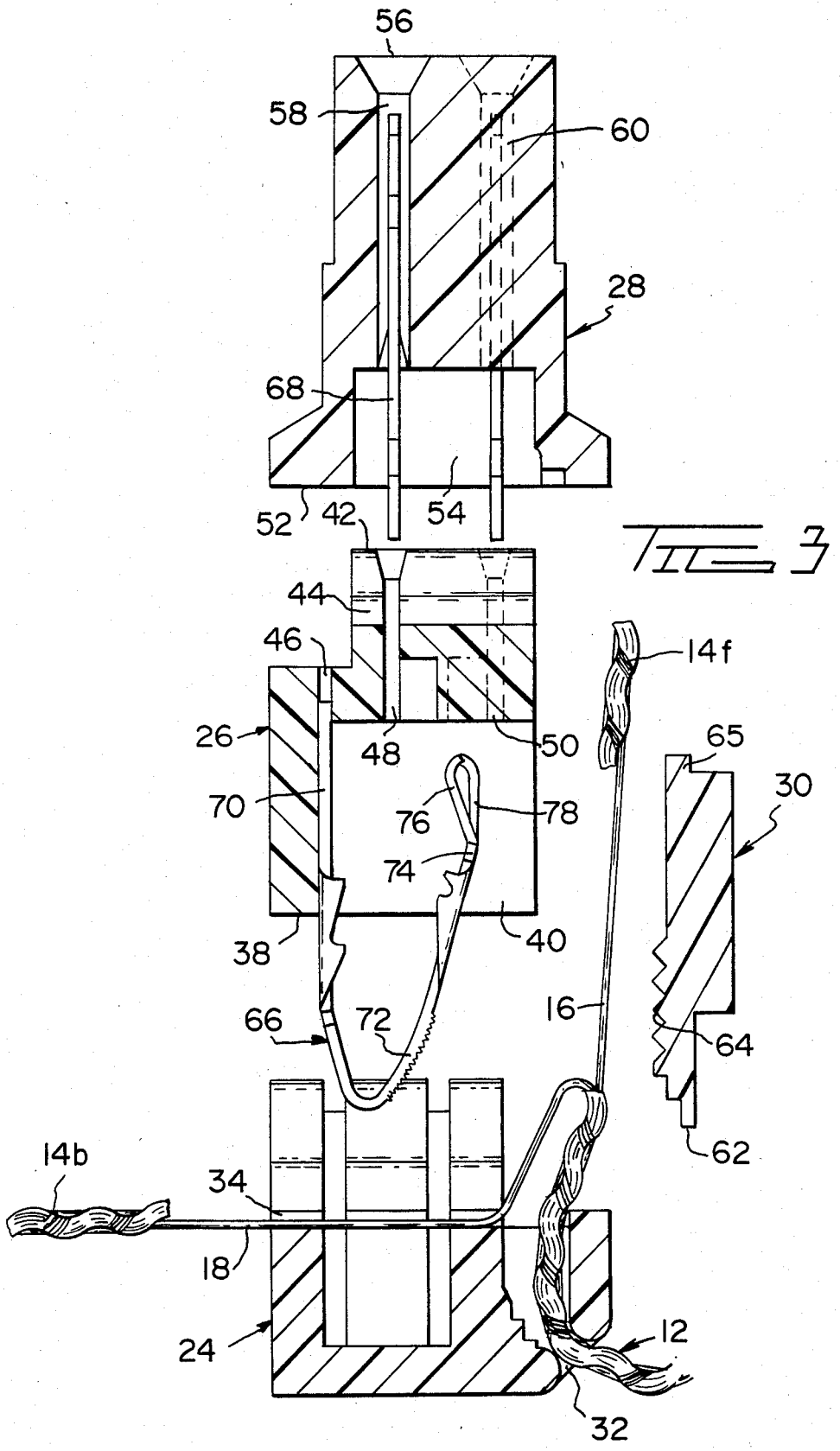
FIG. 3 is a transverse section through the subject connector in an exploded condition.

The prepared end of the cable 12 is fed through the cable entry 32 of base member 24 and the ground conductors 18 are laid in the respective ground wire channels 34. It should be noted that the cable 12 has been illustrated as the type known as a ground signal ground ground signal ground ground signal cable so that four ground wires have been shown in each channel 34. The ground wires pass over the respective terminal recesses 36. The remainder of the cable 12, namely the signal wires 16, is reversibly bent out of the way for the next operation, which can be accomplished in a variety of ways. The intermediate member 26 can be preloaded with first terminals 66 and intermediate member 26 applied to the base member 24. The intermediate member 26 is carrying the first terminals 66 in an initially condition as shown in FIG. 3. The first terminals 66 engage and secure the ground conductors 18 at which time they can be trimmed removing the base piece 14*b*. Further movement of the first terminals 66 drives the ground wires 18 into the recesses 36. The terminals collapse to the position shown in FIG. 4 securing the ground wires against the wall of the base member.

Figure 4:
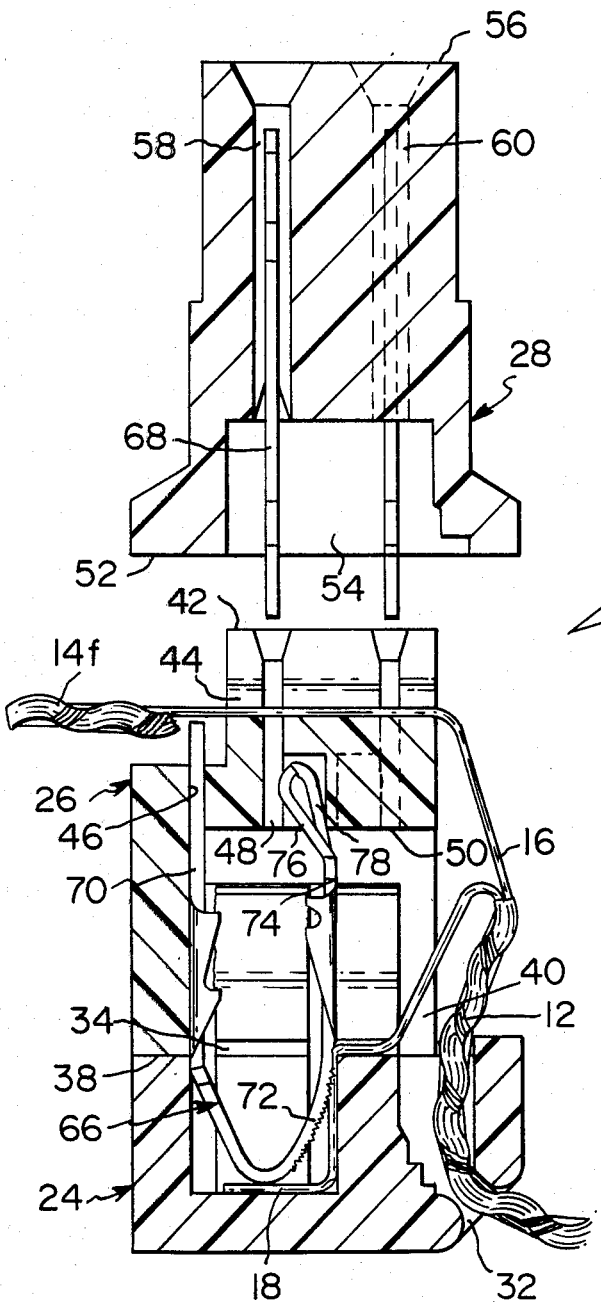
FIG. 4 is a transverse section similar to FIG. 3 showing the connector in a partially assembled condition.

As an alternative, the first terminals 66 could be selectively or gang applied to the ground wires 18 driving them to the position shown in FIG. 4. This would have a two fold advantage. First, the terminals 66 could be ganged together to provide a single ground for the connector and second, this exposes the arms 76, 78 of the first terminals so that they can be bent appropriately for mating with a respective second terminal 68 thus providing programmed ground for the connector.

Figure 5:
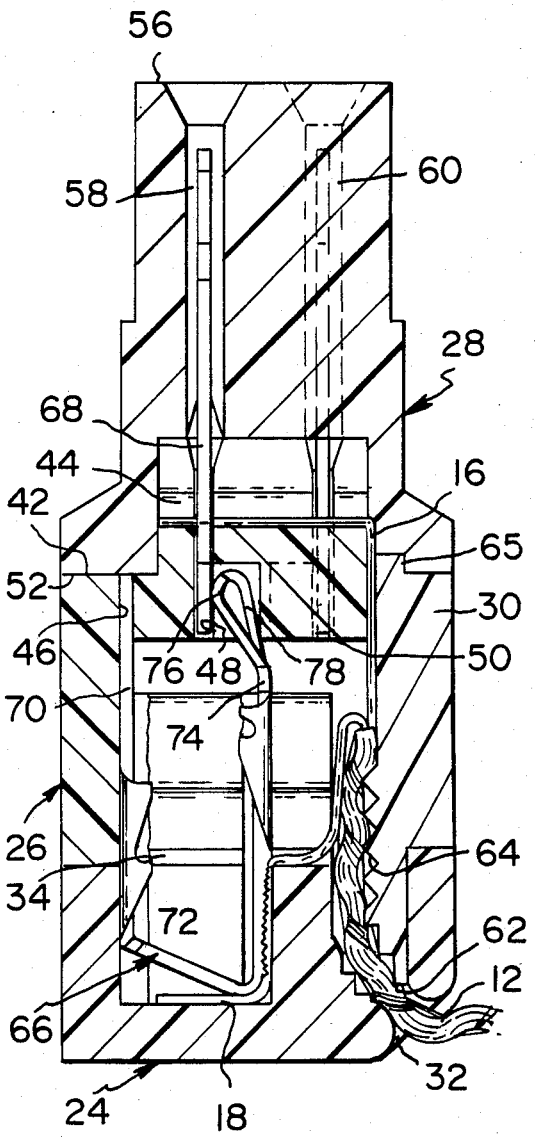
FIG. 5 is a transverse section similar to FIGS. 3 and 4 showing the subject connector in a fully assembled condition.

The signal conductors 16 are then fed across the profiled surface 42 of the intermediate member 26 to lie in the respective channels 44, as shown in FIG. 5. Application of the mating member 28 accomplishes several functions. First, it secures the upper end 65 of the cover 30 to hold the cover tightly in place against the cable 12. Second, it also engages the end of the first portion 16 of each first terminal 66 and drives it downwardly so that the intermediate portion 72 grips the ground wires 18 tightly against a surface of the recess 36; assuming the first of the above mentioned assembly techniques. Each first terminal is also provided with lances which help secure it in base member 24 and can be used to secure intermediate member 26 to the base member. The second terminals 68 carried by the mating member 28 enter the respective passages 48, 50 of the intermediate member 26 and can affect latching engagement therewith making an insulation piercing engagement with a respective signal wires 16. Upon first engagement of the second terminals 68 with the signal wires 16, the wires will be sufficiently secured to trim them removing the excess wire and base piece 14*e*. Some of the second terminals 68 will extend through the respective passages 48, 50 to make a wiping engagement with an arm 76 or 78 of a first terminal 66 thus bringing ground to the mating face 56.

It is to be understood that the present invention can be used to intermate with a pin array, pin connector or the like (none of which is shown). The subject connector can be provided with any of the usual additional features such as profiling, polarizing or keying extensions and latching, ejecting or securing means. It is possible to provide the various members with additional means to secure them together in the assembled condition and not merely rely upon a frictional interfit as might be assumed from the drawings as presented.

We claim:

1. A method for terminating multi-conductor woven cable in an electrical connector of the type wherein a plurality of ground and signal conductors are secured in parallel spaced relationship in a patterned array in a woven cloth base, portions of the cable being so formed as to have the conductors loose from one or both sides of the base, said method comprising the steps of:

feeding a free end of the cable to a base member of said electrical connector and disposing said ground conductors in respective ones of a plurality of channels of said base member;

applying a plurality of first terminals to said base member, each said first terminal engaging and securing at least one ground conductor in a respective channel, each of said first terminals having arms which can be selectively bent;

applying intermediate member having a first face engaging said base member and a profiled oppositely directed second face; disposing said signal conductors on the profile face of said intermediate member; and applying to said sub-assembly of said base and intermediate member a mating member carrying a plurality of second terminals which selectively make contact with respective signal conductors and the arms of said first terminals whereby both said signal conductors and ground conductors are terminated and ground of the connector is programmed.

2. A method according to claim 1 wherein said first terminals are carried by said intermediate member and said first terminals and said intermediate member are applied in a single step.

3. A method according to claim 1 wherein said cable is prepared by the following steps:

making a first cut transversely of the cable to form two end segments;

making a second cut transversely of the base only to free the ground conductors with a segment of base at their free end; and making a third cut transversely of the base only to free the signal conductors with a segment of base at their free end.

4. A method according to claim 3 further comprising the step of trimming excess base material from the prepared cable end.

5. An electrical connector for terminating multi-conductor woven cable of the type wherein a plurality of ground and signal conductors are secured in parallel spaced relationship in a patterned array in a woven cloth base, portions of the cable being so formed as to have the conductors loose from one or both sides of the base, said connector comprising:

an elongated base member of rigid insulative material defining an elongated cable receiving slot and a plurality of ground wire receiving channels extending normal to said slot along a first surface, and at least one terminal receiving recess in said base member intersecting each said channel;

an elongated intermediate member having oppositely directed profiled first and second surfaces and a plurality of terminal passages extending between said surfaces;

an elongated mating member of rigid insulative material having a mating face and an oppositely directed surface with a plurality of terminal passages extending between said face and said surface;

at least one first terminal received in said terminal receiving recess of said base member and engaging and securing at least one ground conductor in each said channel each said at least one first terminal having an integral deformable extension; and a plurality of second terminals each received in a respective passage of said mating member with a mating portion directed toward said mating face and a signal conductor engaging portion depending from said surface to engage a signal conductor on said intermediate member and said deformable extension of said at least one first terminal being bent to selectively engage a second terminal thereby programming ground for said connector.

6. An electrical connector according to claim 5 wherein at least one said first terminal is carried by said intermediate member, said first terminal and said intermediate member being applied as a unit to said base member forming a subassembly.

7. An electrical connector according to claim 5 wherein said terminal receiving recess is a single recess intersecting each said channel, and said first terminal is an elongated member engaging each said ground conductor.

8. An electrical connector according to claim 5 further comprising a plurality of terminal receiving recesses each intersecting a respective one of said channels, and a like plurality of second terminals each received in a respective one of said terminal receiving recesses and engaging and securing ground conductors in the respective channels.

9. An electrical connector according to claim 5 wherein each said at least one first terminal has an insulator piercing ground wire engaging surface.

10. An electrical connector according to claim 5 wherein each said at least one first terminal further comprises means to grippingly engage said base member.

11. An electrical connector according to claim 5 wherein each said at least one first terminal further comprises means to engage said intermediate member.

12. An electrical connector according to claim 5 wherein said intermediate member is formed by a pair of mating members one of which defines said first surface for engaging said base member and the other of which defines said second surface to receive said signal conductors.

13. An electrical connector according to claim 5 wherein said signal conductor engaging portion of each said second terminal comprises an insulation piercing, slotted plate configuration.

14. An electrical connector according to claim 5 wherein each said second terminal further comprises means to grippingly engage said mating member.

15. An electrical connector according to claim 5 further comprising:

at least one cover member of insulative material engagable with said base member and said mating member to enclose said cable.

16. An electrical connector according to claim 15 wherein said cover member further comprises cable strain relief means.

* * * * *